US008291976B2

(12) United States Patent
Schultz et al.

(10) Patent No.: US 8,291,976 B2
(45) Date of Patent: Oct. 23, 2012

(54) FLUID FLOW CONTROL DEVICE

(75) Inventors: Roger L. Schultz, Ninnekah, OK (US); Robert L. Pipkin, Marlow, OK (US); Travis W. Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 405 days.

(21) Appl. No.: 12/635,612

(22) Filed: Dec. 10, 2009

(65) Prior Publication Data

US 2011/0139453 A1 Jun. 16, 2011

(51) Int. Cl.

| | |
|---|---|
| ***E21B 17/18*** | (2006.01) |
| ***E21B 34/06*** | (2006.01) |
| ***E21B 43/12*** | (2006.01) |
| ***E21B 43/24*** | (2006.01) |

(52) U.S. Cl. ..... 166/272.3; 137/811; 166/50; 166/91.1; 166/272.7; 166/303; 166/316; 166/334.1; 166/334.4; 166/373

(58) Field of Classification Search ..... None
See application file for complete search history.

(56) References Cited

U.S. PATENT DOCUMENTS

| | | | | |
|---|---|---|---|---|
| 1,329,559 A | | 2/1920 | Telsa | |
| 2,762,437 A | | 9/1956 | Egan et al. | |
| 2,849,070 A | | 8/1958 | Maly | |
| 2,945,541 A | | 7/1960 | Maly et al. | |
| 2,981,332 A | | 4/1961 | Miller et al. | |
| 2,981,333 A | | 4/1961 | Miller et al. | |
| 3,186,484 A | * | 6/1965 | Waterman | 166/52 |
| 3,233,622 A | * | 2/1966 | Boothe | 137/825 |
| 3,375,842 A | * | 4/1968 | Reader | 137/830 |
| 3,461,897 A | * | 8/1969 | Kwok | 137/809 |
| 3,477,506 A | | 11/1969 | Malone | |
| 3,730,673 A | * | 5/1973 | Straitz, III | 431/278 |
| 4,268,245 A | * | 5/1981 | Straitz, III | 431/202 |
| 4,276,943 A | | 7/1981 | Holmes | |

(Continued)

FOREIGN PATENT DOCUMENTS

EP 0834342 B1 2/2003

(Continued)

OTHER PUBLICATIONS

Foreign communication from a related counterpart application—International Search Report and Written Opinion, PCT/US2010/059121, Oct. 13, 2011, 11 pages.

(Continued)

*Primary Examiner* — George Suchfield
(74) *Attorney, Agent, or Firm* — Conley Rose, P.C.

(57) ABSTRACT

A method of servicing a wellbore, comprising providing a fluid diode in fluid communication with the wellbore, and transferring a fluid through the fluid diode. A fluid flow control tool, comprising a tubular diode sleeve comprising a diode aperture, a tubular inner ported sleeve received concentrically within the diode sleeve, the inner ported sleeve comprising an inner port in fluid communication with the diode aperture, and a tubular outer ported sleeved within which the diode sleeve is received concentrically, the outer ported sleeve comprising an outer port in fluid communication with the diode aperture, wherein a shape of the diode aperture, a location of the inner port relative to the diode aperture, and a location of the outer port relative to the diode aperture provide a fluid flow resistance to fluid transferred to the inner port from the outer port and a different fluid flow resistance to fluid transferred to the outer port from the inner port.

21 Claims, 7 Drawing Sheets

U.S. PATENT DOCUMENTS

| | | | | |
|---|---|---|---|---|
| 4,287,952 | A | 9/1981 | Erbstoesser | |
| 4,307,204 | A | 12/1981 | Vidal | |
| 4,393,928 | A * | 7/1983 | Warnock, Sr. | 166/105 |
| 4,491,186 | A | 1/1985 | Alder | |
| 4,808,084 | A | 2/1989 | Tsubouchi et al. | |
| 4,974,674 | A | 12/1990 | Wells | |
| 4,998,585 | A | 3/1991 | Newcomer et al. | |
| 5,333,684 | A | 8/1994 | Walter et al. | |
| 5,337,808 | A | 8/1994 | Graham | |
| 5,337,821 | A | 8/1994 | Peterson | |
| 5,435,393 | A | 7/1995 | Brekke et al. | |
| 5,673,751 | A | 10/1997 | Head et al. | |
| 5,730,223 | A | 3/1998 | Restarick | |
| 5,803,179 | A | 9/1998 | Echols et al. | |
| 5,896,928 | A | 4/1999 | Coon | |
| 6,009,951 | A | 1/2000 | Coronado et al. | |
| 6,015,011 | A | 1/2000 | Hunter | |
| 6,112,815 | A | 9/2000 | Bøe et al. | |
| 6,112,817 | A | 9/2000 | Voll et al. | |
| 6,253,861 | B1 | 7/2001 | Carmichael et al. | |
| 6,305,470 | B1 | 10/2001 | Woie | |
| 6,367,547 | B1 | 4/2002 | Towers et al. | |
| 6,371,210 | B1 | 4/2002 | Bode et al. | |
| 6,431,282 | B1 | 8/2002 | Bosma et al. | |
| 6,478,091 | B1 | 11/2002 | Gano | |
| 6,505,682 | B2 | 1/2003 | Brockman | |
| 6,516,888 | B1 | 2/2003 | Gunnarson et al. | |
| 6,622,794 | B2 | 9/2003 | Zisk, Jr. | |
| 6,627,081 | B1 | 9/2003 | Hilditch et al. | |
| 6,644,412 | B2 | 11/2003 | Bode et al. | |
| 6,679,324 | B2 | 1/2004 | Den Boer et al. | |
| 6,691,781 | B2 | 2/2004 | Grant et al. | |
| 6,695,067 | B2 | 2/2004 | Johnson et al. | |
| 6,719,048 | B1 | 4/2004 | Ramos et al. | |
| 6,719,051 | B2 | 4/2004 | Hailey, Jr. et al. | |
| 6,786,285 | B2 | 9/2004 | Johnson et al. | |
| 6,817,416 | B2 | 11/2004 | Wilson et al. | |
| 6,834,725 | B2 | 12/2004 | Whanger et al. | |
| 6,840,325 | B2 | 1/2005 | Stephenson | |
| 6,851,560 | B2 | 2/2005 | Reig et al. | |
| 6,857,475 | B2 | 2/2005 | Johnson | |
| 6,857,476 | B2 | 2/2005 | Richards | |
| 6,886,634 | B2 | 5/2005 | Richards | |
| 6,907,937 | B2 | 6/2005 | Whanger et al. | |
| 6,935,432 | B2 | 8/2005 | Nguyen | |
| 6,957,703 | B2 | 10/2005 | Trott et al. | |
| 7,013,979 | B2 | 3/2006 | Richard | |
| 7,059,401 | B2 | 6/2006 | Bode et al. | |
| 7,063,162 | B2 | 6/2006 | Daling et al. | |
| 7,096,945 | B2 | 8/2006 | Richards et al. | |
| 7,100,686 | B2 | 9/2006 | Wittrisch | |
| 7,108,083 | B2 | 9/2006 | Simonds et al. | |
| 7,143,832 | B2 | 12/2006 | Freyer | |
| 7,185,706 | B2 | 3/2007 | Freyer | |
| 7,207,386 | B2 | 4/2007 | Brannon et al. | |
| 7,290,606 | B2 | 11/2007 | Coronado et al. | |
| 7,409,999 | B2 | 8/2008 | Henriksen et al. | |
| 7,419,002 | B2 | 9/2008 | Dybevik et al. | |
| 7,426,962 | B2 | 9/2008 | Moen et al. | |
| 7,455,104 | B2 | 11/2008 | Duhon et al. | |
| 7,469,743 | B2 | 12/2008 | Richards | |
| 7,537,056 | B2 | 5/2009 | MacDougall | |
| 7,644,773 | B2 | 1/2010 | Richard | |
| 7,708,068 | B2 | 5/2010 | Hailey, Jr. | |
| 7,918,272 | B2 | 4/2011 | Gaudette et al. | |
| 2005/0110217 | A1 | 5/2005 | Wood et al. | |
| 2006/0185849 | A1 | 8/2006 | Edwards et al. | |
| 2007/0012454 | A1 * | 1/2007 | Ross et al. | 166/375 |
| 2007/0246225 | A1 | 10/2007 | Hailey, Jr. et al. | |
| 2007/0246407 | A1 | 10/2007 | Richards et al. | |
| 2008/0035330 | A1 | 2/2008 | Richards | |
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2008/0041588 | A1 | 2/2008 | Richards et al. | |
| 2008/0149323 | A1 | 6/2008 | O'Malley et al. | |
| 2008/0283238 | A1 | 11/2008 | Richards et al. | |
| 2009/0020292 | A1 * | 1/2009 | Loretz et al. | 166/373 |
| 2009/0078427 | A1 | 3/2009 | Patel | |
| 2009/0078428 | A1 | 3/2009 | Ali | |
| 2009/0101354 | A1 | 4/2009 | Holmes et al. | |
| 2009/0133869 | A1 | 5/2009 | Clem | |
| 2009/0151925 | A1 | 6/2009 | Richards et al. | |
| 2009/0188661 | A1 * | 7/2009 | Bizon | 166/52 |
| 2009/0205834 | A1 | 8/2009 | Garcia et al. | |
| 2011/0042092 | A1 * | 2/2011 | Fripp et al. | 166/319 |

FOREIGN PATENT DOCUMENTS

| | | | |
|---|---|---|---|
| EP | 1857633 | A2 | 11/2007 |
| GB | 2314866 | A | 1/1998 |
| GB | 2341405 | A | 3/2000 |
| GB | 2356879 | A | 6/2001 |
| GB | 2371578 | A | 7/2002 |
| WO | 0214647 | A1 | 2/2002 |
| WO | 02059452 | A1 | 8/2002 |
| WO | 02075110 | A1 | 9/2002 |
| WO | 02090714 | A1 | 11/2002 |
| WO | 03062597 | A1 | 7/2003 |
| WO | 2004057715 | A2 | 7/2004 |
| WO | 2005090741 | A1 | 9/2005 |
| WO | 2005116394 | A1 | 12/2005 |
| WO | 2006003112 | A1 | 1/2006 |
| WO | 2006003113 | A1 | 1/2006 |
| WO | 2008024645 | A2 | 2/2008 |
| WO | 2008024645 | A3 | 2/2008 |
| WO | 2008053364 | A2 | 5/2008 |
| WO | 2008053364 | A3 | 5/2008 |
| WO | 2009048822 | A2 | 4/2009 |
| WO | 2009048823 | A2 | 4/2009 |
| WO | 2009052076 | A2 | 4/2009 |
| WO | 2009052103 | A2 | 4/2009 |
| WO | 2009052149 | A2 | 4/2009 |
| WO | 2009067021 | A2 | 5/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Examiner's Answer dated Aug. 21, 2009 (8 pages), U.S. Appl. No. 11/466,022, filed Aug. 21, 2006.

"Fluidics," Microsoft® Encarta® Online Encyclopedia, Aug. 13, 2009, 1 page, © 1993-2009 by Microsoft Corporation.

Foreign communication from a counterpart application—International Search Report, PCT/NO02/00158, Aug. 28, 2002, 2 pages.

Foreign communication from a counterpart application—International Preliminary Examination Report, PCT/NO02/00158, Jul. 2, 2003, 3 pages.

Foreign communication from a counterpart application—International Search Report and Written Opinion, PCT/US07/75743, Feb. 11, 2008, 4 pages.

Foreign communication from a counterpart application—International Preliminary Report on Patentability, Feb. 24, 2009, PCT/US07/75743, 4 pages.

Foreign communication from a counterpart application—International Search Report and Written Opinion, Feb. 27, 2009, PCT/IB07/04287, 4 pages.

Foreign communication from a counterpart application—International Preliminary Report on Patentability, Jul. 28, 2009, PCT/IB2007/004287, 4 pages.

Gebben, Vernon D., "Vortex valve performance power index," NASA TM X-52257, May 1967, pp. 1-14 plus 2 cover pages and Figures 1-8, National Aeronautics and Space Administration.

Haakh, Dr.-Ing. Frieder, "Vortex chamber diodes as throttle devices in pipe systems. Computation of transient flow," 2003, pp. 53-59, vol. 41, No. 1, Journal of Hydraulic Research.

Holmes, Allen B., et al., "A fluidic approach to the design of a mud pulser for bore-hole telemetry while drilling," DRCMS Code: 7-36AA-7100, HDL Project: A54735, Aug. 1979, pp. 1, 2, 5, 6, 9-27, and 29-37, Department of the Interior, U.S. Geological Survey, Washington, D.C.

Kirshner, Joseph M., et al., "Design Theory of Fluidic Components", 1975, pp. 276-283, 382-389, plus 1 publishing page, Academic Press, A Subsidiary of Harcourt Brace Jovanovich, Publishers.

Kirshner, Joseph M., "Fluid Amplifiers", undated, pp. 187-193, 228, 229, and 1 cover page, McGraw-Hill Book Company.
NuVision product profile entitled "Vortex diode pumps: no moving part pumping systems," undated, 2 pages, NuVision Engineering.
Notice of Allowance dated Jun. 28, 2010 (8 pages), U.S. Appl. No. 11/409,734 filed Apr. 24, 2006.
Office Action dated Feb. 8, 2008 (30 pages), U.S. Appl. No. 11/466,022, filed Aug. 21, 2006.
Office Action dated Aug. 26, 2008 (9 pages), U.S. Appl. No. 11/466,022 filed Aug. 21, 2006.
Office Action dated Oct. 20, 2008 (30 pages), U.S. Appl. No. 11/409,734, filed Apr. 24, 2006.
Office Action dated Dec. 17, 2008 (17 pages), U.S. Appl. No. 11/407,704, filed Apr. 20, 2006.
Office Action dated Mar. 16, 2009 (47 pages), U.S. Appl. No. 11/671,319, filed Feb. 5, 2007.
Office Action dated Apr. 14, 2009 (9 pages), U.S. Appl. No. 11/409,734, filed Apr. 24, 2006.
Office Action dated Jul. 20, 2009 (19 pages), U.S. Appl. No. 11/596,571, filed Jan. 10, 2007.
Office Action (Final) dated Nov. 12, 2009 (17 pages), U.S. Appl. No. 11/409,734, filed Apr. 24, 2006.
Office Action dated Dec. 3, 2009 (10 pages), U.S. Appl. No. 11/852,295, filed Sep. 8, 2007.
Office Action dated Mar. 11, 2010 (17 pages), U.S. Appl. No. 11/596,571, filed Jan. 10, 2007.
Office Action dated Mar. 24, 2010 (48 pages), U.S. Appl. No. 11/958,466, filed Dec. 18, 2007.
Office Action dated Mar. 5, 2010 (24 pages), U.S. Appl. No. 11/409,734 filed Apr. 24, 2006.
Patent application entitled "Method and apparatus for autonomous downhole fluid selection with vortex assembly," by Michael Linley Fripp, et al., filed Aug. 18, 2009 as U.S. Appl. No. 12/542,695.
Patent application by Michael Linley Fripp, et al., filed Feb. 4, 2010 as U.S. Appl. No. 12/700,685.
Weatherford product brochure entitled, "Application answers—Combating coning by creating even flow distribution in horizontal sand-control completions," 2005, 4 pages, Weatherford.
Willingham, J. D., et al., "Perforation friction pressure of fracturing fluid slurries," SPE 25891, 1993, pp. 479-491 plus 1 page corrected drawing, Society of Petroleum Engineers, Inc.
Crow, S.L., et al., "Means for passive inflow control upon gas breakthrough," SPE 102208, 2006, 6 pages, Society of Petroleum Engineers.
Foreign communication from a counterpart application—Australian Examiner's Report, 2007315792, Mar. 31, 2010, 1 page.
Foreign communication from a counterpart application—Chinese Office Action, 200580016654.2, Feb. 27, 2009, 6 pages.
Foreign communication from a counterpart application—UK Search Report, GB0707831.4, Jul. 19, 2007, 3 pages.

* cited by examiner

FLUID FLOW CONTROL DEVICE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates wellbore servicing tools.

BACKGROUND OF THE INVENTION

Some wellbore servicing tools provide a plurality of fluid flow paths between the interior of the wellbore servicing tool and the wellbore. However, fluid transfer through such a plurality of fluid flow paths may occur in an undesirable and/or non-homogeneous manner. The variation in fluid transfer through the plurality of fluid flow paths may be attributable to variances in the fluid conditions of an associated hydrocarbon formation and/or may be attributable to operational conditions of the wellbore servicing tool, such as a fluid flow path being unintentionally restricted by particulate matter.

SUMMARY OF THE INVENTION

Disclosed herein is a method of servicing a wellbore, comprising providing a fluid diode in fluid communication with the wellbore, and transferring a fluid through the fluid diode.

Also disclosed herein is a fluid flow control tool, comprising a tubular diode sleeve comprising a diode aperture, a tubular inner ported sleeve received concentrically within the diode sleeve, the inner ported sleeve comprising an inner port in fluid communication with the diode aperture, and a tubular outer ported sleeved within which the diode sleeve is received concentrically, the outer ported sleeve comprising an outer port in fluid communication with the diode aperture, wherein a shape of the diode aperture, a location of the inner port relative to the diode aperture, and a location of the outer port relative to the diode aperture provide a fluid flow resistance to fluid transferred to the inner port from the outer port and a different fluid flow resistance to fluid transferred to the outer port from the inner port.

Further disclosed herein is a method of recovering hydrocarbons from a subterranean formation, comprising injecting steam into a wellbore that penetrates the subterranean formation, the steam promoting a flow of hydrocarbons of the subterranean formation, and receiving at least a portion of the flow of hydrocarbons, wherein at least one of the injecting steam and the receiving the flow of hydrocarbons is controlled by a fluid diode.

Further disclosed herein is a fluid flow control tool for servicing a wellbore, comprising a fluid diode comprising a low resistance entry and a high resistance entry, the fluid diode being configured to provide a greater resistance to fluid transferred to the low resistance entry from the high resistance entry at a fluid mass flow rate as compared to the fluid being transferred to the high resistance entry from the low resistance entry at the fluid mass flow rate. The fluid flow control tool may further comprise a tubular diode sleeve comprising a diode aperture, an inner ported sleeve received substantially concentrically within the diode sleeve, the inner ported sleeve comprising an inner port, and an outer ported sleeve disposed substantially concentrically around the diode sleeve, the outer ported sleeve comprising an outer port. The inner port may be associated with the low resistance entry and the outer port may be associated with the high resistance entry. The inner port may be associated with the high resistance entry and the outer port may be associated with the low resistance entry. The diode sleeve may be movable relative to the inner ported sleeve so that the inner port may be movable into association with the low resistance entry and the diode sleeve may be moveable relative to the outer ported sleeve and so that the outer port may be moveable into association with the high resistance entry. The fluid diode may be configured to generate a fluid vortex when fluid is transferred from the high resistance entry to the low resistance entry. The fluid flow control tool may be configured to transfer fluid between an inner bore of the fluid flow control tool and the wellbore.

DETAILED DESCRIPTION OF THE PREFERRED EMBODIMENTS

Figure 1:
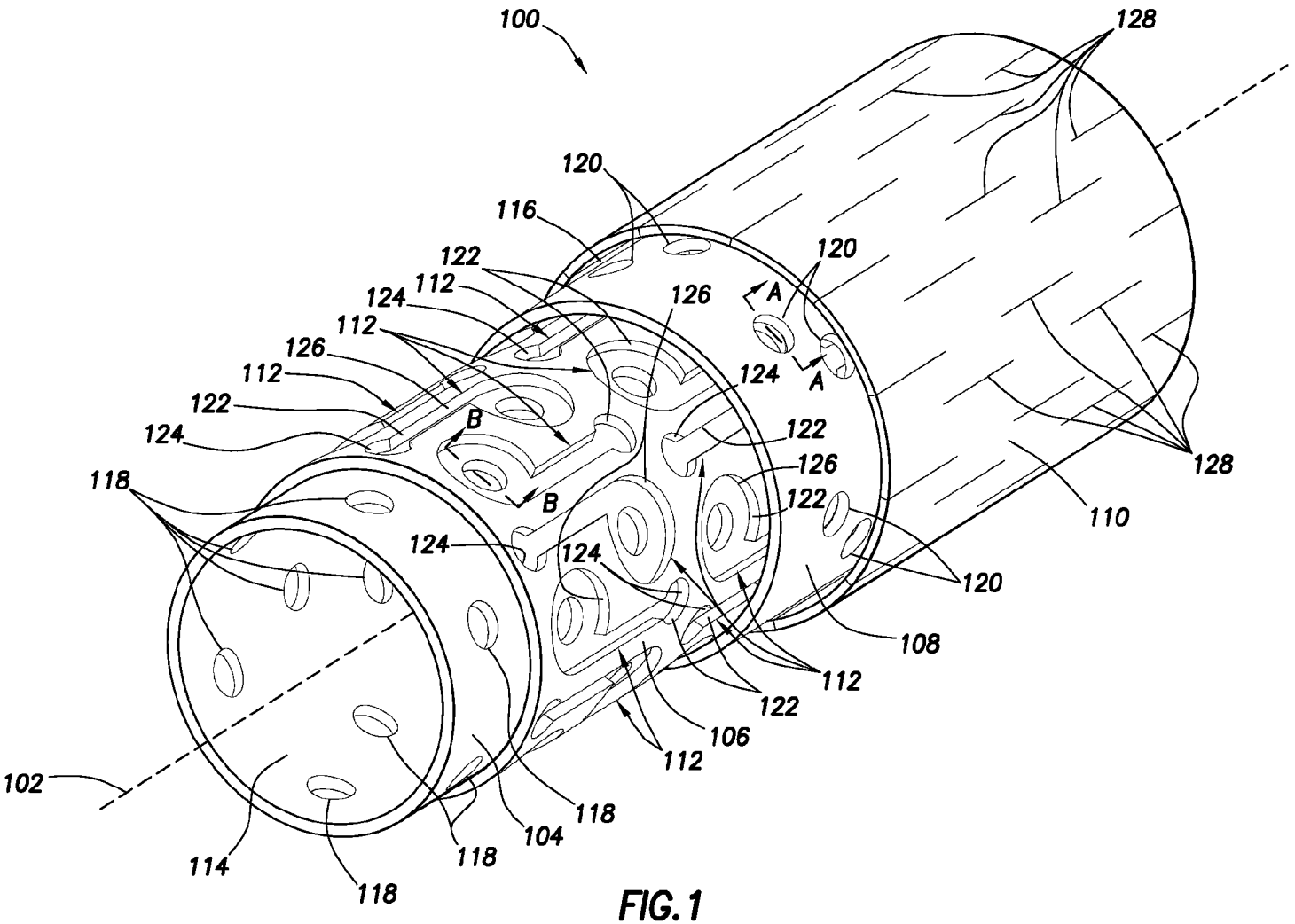
FIG. 1 is a cut-away oblique view of a fluid flow control tool according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation.

As used herein, the term "zonal isolation tool" will be used to identify any type of actuatable device operable to control the flow of fluids or isolate pressure zones within a wellbore, including but not limited to a bridge plug, a fracture plug, and a packer. The term zonal isolation tool may be used to refer to a permanent device or a retrievable device.

As used herein, the term "bridge plug" will be used to identify a downhole tool that may be located and set to isolate a lower part of the wellbore below the downhole tool from an upper part of the wellbore above the downhole tool. The term bridge plug may be used to refer to a permanent device or a retrievable device.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 is an oblique view of a fluid flow control tool 100 according to an embodiment of the present disclosure. As explained below, it will be appreciated that one or more components of the tool 100 may lie substantially coaxial with a central axis 102. The tool 100 generally comprises four substantially coaxially aligned and/or substantially concentric cylindrical tubes explained in greater detail below. Listed in successively radially outward located order, the tool 100 comprises an innermost inner ported sleeve 104, a diode sleeve 106, an outer ported sleeve 108, and an outermost outer perforated liner 110. The various components of tool 100 shown in FIG. 1 are illustrated in various degrees of foreshortened longitudinal length to provide a clearer view of their features. More specifically, while not shown as such in FIG. 1, in some embodiments, each of the inner ported sleeve 104, the diode sleeve 106, the outer ported sleeve 108, and the outer perforated liner 110 may be substantially similar in longitudinal length. The tool 100 further comprises a plurality of fluid diodes 112 that are configured to provide a fluid path between an innermost bore 114 of the tool 100 and a substantially annular fluid gap space 116 between the outer ported sleeve 108 and the outer perforated liner 110. The inner ported sleeve 104 comprises a plurality of inner ports 118 and the outer ported sleeve 108 comprises a plurality of outer ports 120. The diode sleeve 106 comprises a plurality of diode apertures 122. The various inner ports 118, outer ports 120, and diode apertures 122 are positioned relative to each other so that each diode aperture 122 may be associated with one inner port 118 and one outer port 120.

Further, each diode aperture 122 comprises a high resistance entry 124 and a low resistance entry 126. However, the terms high resistance entry 124 and low resistance entry 126 should not be interpreted as meaning that fluid may only enter into the diode aperture 122 through the entries 124, 126. Instead, the term high resistance entry 124 shall be interpreted as indicating that the diode aperture 122 comprises geometry that contributes to a higher resistance to fluid transfer through fluid diode 112 when fluid enters through the high resistance entry 124 and exits through the low resistance entry 126 as compared to a resistance to fluid transfer through fluid diode 112 when fluid enters through the low resistance entry 126 and exits through the high resistance entry 124. Tool 100 is shown in FIGS. 1-4 as being configured so that inner ports 118 are associated with low resistance entries 126 while outer ports 120 are associated with high resistance entries 124. In other words, with the tool 100 configured as shown in FIGS. 1-4, fluid flow from the fluid gap space 116 to the bore 114 through the fluid diodes 112 is affected by a higher resistance to such fluid transfer as compared to fluid flow from the bore 114 to the fluid gap space 116 through the fluid diodes 112. In this embodiment of the tool 100, the diode apertures 122 are configured to provide the above-described flow direction dependent fluid transfer resistance by causing fluid to travel a vortex path prior to exiting the diode aperture 122 through the low resistance entry 126. However, in alternative embodiments, the diode apertures 122 may comprise any other suitable geometry for providing a fluid diode effect on fluid transferred through the fluid diodes 112.

Figure 2:
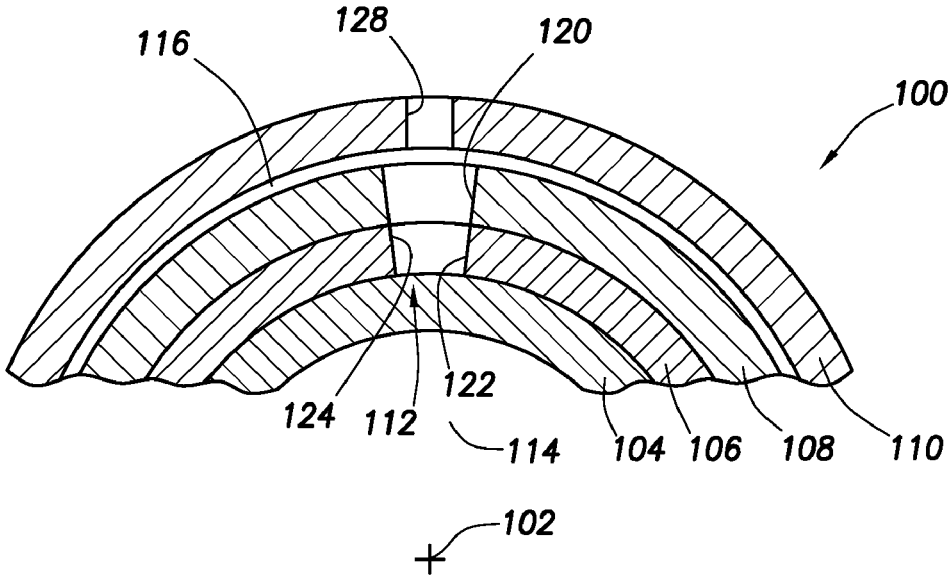
FIG. 2 is a partial cross-sectional view of the fluid flow control tool of FIG. 1 taken along cutting plane A-A of FIG. 1.
Figure 3:
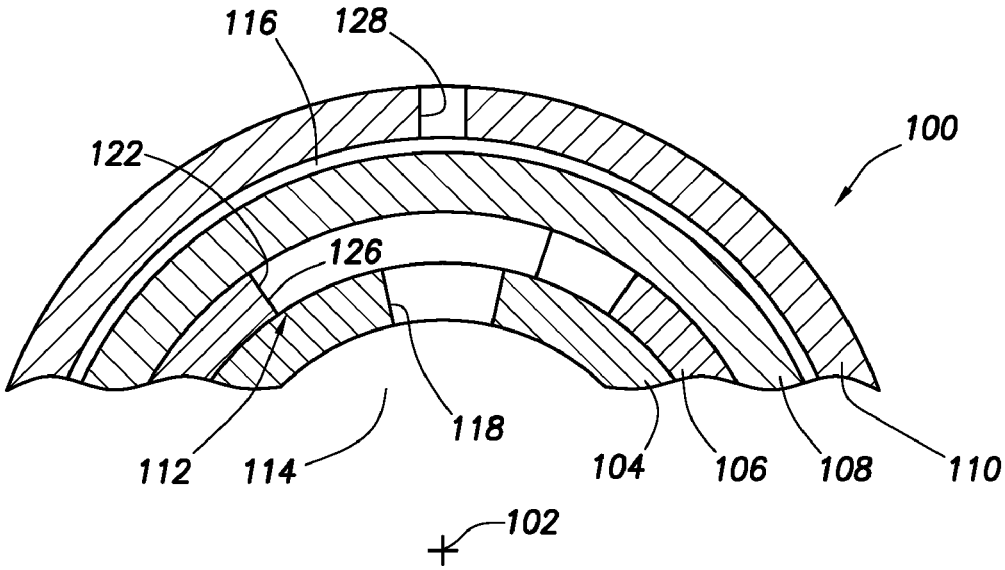
FIG. 3 is a partial cross-sectional view of the fluid flow control tool of FIG. 1 taken along cutting plane B-B of FIG. 1.

Referring now to FIGS. 2 and 3, partial cross-sectional views of the tool 100 of FIG. 1 are shown. FIG. 2 shows a partial cross-sectional view taken along cutting plane A-A of FIG. 1 while FIG. 3 shows a partial cross-sectional view taken along cutting plane B-B of FIG. 1. FIG. 2 shows that a fluid path exists between a space exterior to the outer perforated liner 110 and the space defined by the diode aperture 122. More specifically, a slit 128 of the outer perforated liner 110 joins the space exterior to the outer perforated liner 110 to a space defined by the outer port 120. However, in alternative embodiments, a perforated liner 110 may comprise drilled holes, a combination of drilled holes and slits 128, and/or any other suitable apertures. It will be appreciated that the perforated liner 110 may alternatively comprise features of any other suitable slotted liner, screened liner, and/or perforated liner. In this embodiment and configuration, the outer port 120 is in fluid communication with the space defined by the high resistance entry 124 of the diode aperture 122. FIG. 3 shows that the space defined by the low resistance entry 126 of the diode aperture 122 is in fluid communication with the space defined by the inner port 118. Inner port 118 is in fluid communication with the bore 114, thereby completing a fluid path between the space exterior to the outer perforated liner 110 and the bore 114. It will be appreciated that the diode aperture 122 may delimit a space that follows a generally concentric orbit about the central axis 102. In some embodiments, fluid transfer through the fluid diode 112 may encounter resistance at least partially attributable to changes in direction of the fluid as the fluid orbits about the central axis 102. The configuration of tool 100 shown in FIGS. 2 and 3 may be referred to as an "inflow control configuration" since the fluid diode 112 is configured to more highly resist fluid transfer into the bore 114 through the fluid diode 112 than fluid transfer out of the bore 114 through the fluid diode 112.

Figure 4:
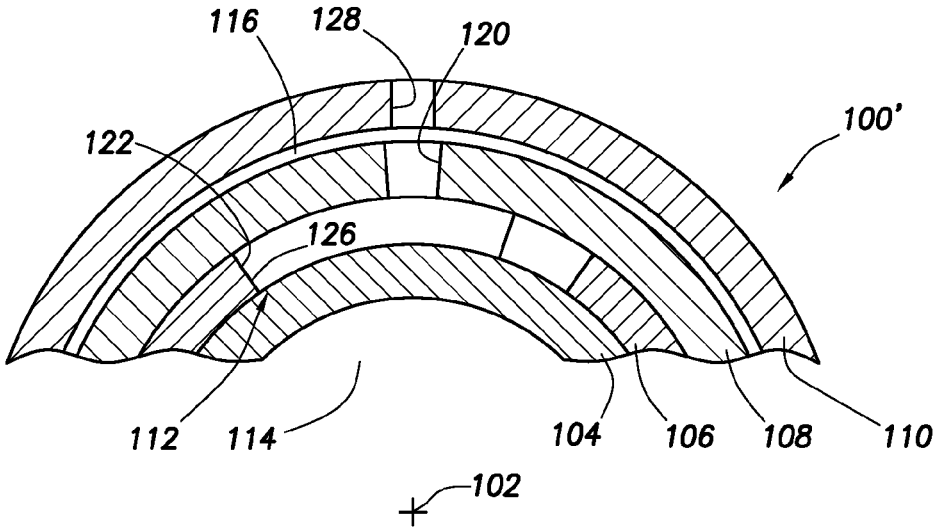
FIG. 4 is a partial cross-sectional view of a fluid flow control tool according to another embodiment of the disclosure.
Figure 5:
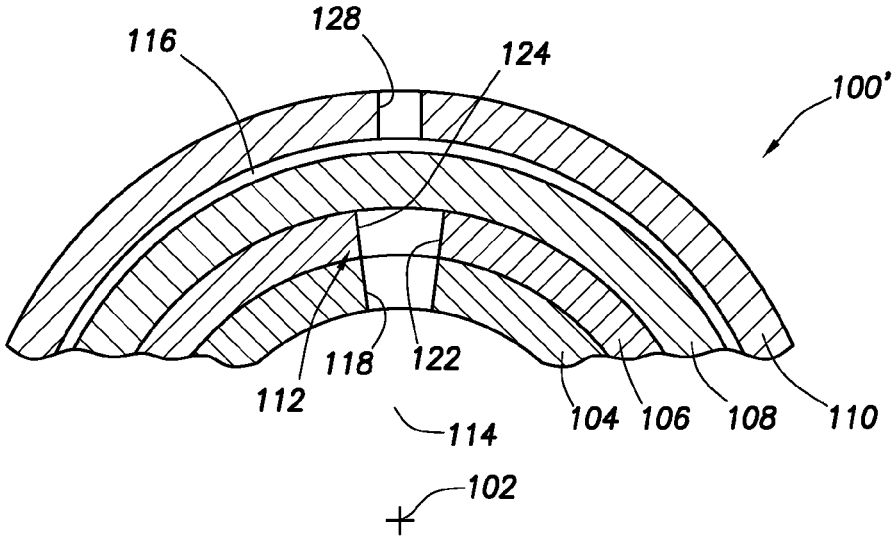
FIG. 5 is another partial cross-sectional view of the fluid flow control tool of FIG. 4.

Referring now to FIGS. 4 and 5, partial cross-sectional views of the tool 100 of FIG. 1 are shown with the tool 100 in an alternative configuration. More specifically, while the tool 100 as configured in FIG. 1 provides a higher resistance to fluid transfer from the fluid gap space 116 to the bore 114, the tool 100' of FIGS. 4 and 5 is configured in the reverse. In other words, the tool 100' as shown in FIGS. 4 and 5 is configured to provide higher resistance to fluid transfer from the bore 114 to the fluid gap space 116. FIG. 4 shows that a fluid path exists between a space exterior to the outer perforated liner 110 and the space defined by the diode aperture 122. More specifically, a slit 128 of the outer perforated liner 110 joins the space exterior to the outer perforated liner 110 to a space defined by the outer port 120. In this embodiment and configuration, the outer port 120 is in fluid communication with the space defined by the low resistance entry 126 of the diode aperture 122. FIG. 5 shows that the space defined by the high resistance entry 124 of the diode aperture 122 is in fluid communication with the space defined by the inner port 118. Inner port 118 is in fluid communication with the bore 114, thereby completing a fluid path between the space exterior to the outer perforated liner 110 and the bore 114. Accordingly, the configuration shown in FIGS. 4 and 5 may be referred to as an "outflow control configuration" since the fluid diode 112 is configured to more highly resist fluid transfer out of the bore 114 through the fluid diode 112 than fluid transfer into the bore 114 through the fluid diode 112.

Figure 6:
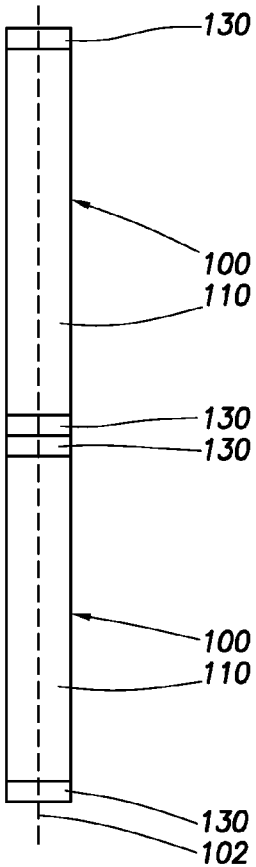
FIG. 6 is a simplified schematic view of a plurality of fluid flow control tools of FIG. 1 connected together to form a portion of a work string according to an embodiment of the disclosure.

Referring now to FIG. 6, a simplified representation of two tools 100 joined together is shown. It will be appreciated that, in some embodiments, tools 100 may comprise connectors 130 configured to join the tools 100 to each other and/or to other components of a wellbore work string. In this embodiment, it will be appreciated that tools 100 are configured so that joining the two tools 100 together in the manner shown in FIG. 4, the bores 114 are in fluid communication with each other. However, in this embodiment, seals and/or other suitable features are provided to segregate the fluid gap spaces 116 of the adjacent and connected tools 100. In alternative embodiments, the tools 100 may be joined together by tubing, work string elements, or any other suitable device for connecting the tools 100 in fluid communication.

Figure 7:
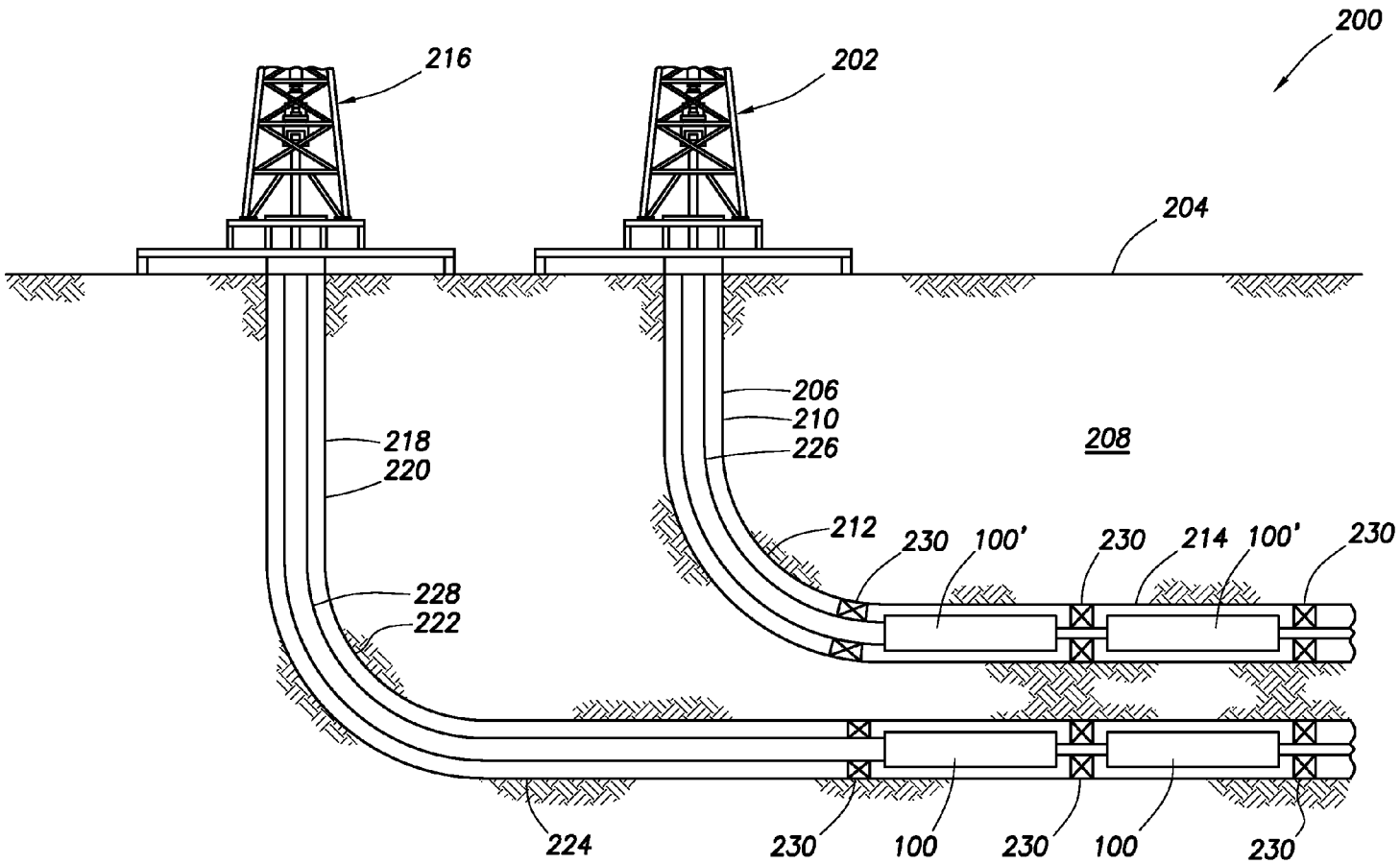
FIG. 7 is a cut-away view of a wellbore servicing system comprising a plurality of fluid flow control tools of FIG. 1 and a plurality of fluid flow control tools of FIG. 5.

Referring now to FIG. 7, a wellbore servicing system 200 is shown as configured for producing and/or recovering hydrocarbons using a steam assisted gravity drainage (SAGD) method. System 200 comprises an injection service rig 202 (e.g., a drilling rig, completion rig, or workover rig) that is positioned on the earth's surface 204 and extends over and around an injection wellbore 206 that penetrates a subterranean formation 208. While an injection service rig 202 is shown in FIG. 7, in some embodiments, a service rig 202 may not be present, but rather, a standard surface wellhead completion (or sub-surface wellhead completion in some embodiments) may be associated with the system 200. The injection wellbore 206 may be drilled into the subterranean formation 208 using any suitable drilling technique. The injection wellbore 206 extends substantially vertically away from the earth's surface 204 over a vertical injection wellbore portion 210, deviates from vertical relative to the earth's surface 204 over a deviated injection wellbore portion 212, and transitions to a horizontal injection wellbore portion 214.

System 200 further comprises an extraction service rig 216 (e.g., a drilling rig, completion rig, or workover rig) that is positioned on the earth's surface 204 and extends over and around an extraction wellbore 218 that penetrates the subterranean formation 208. While an extraction service rig 216 is shown in FIG. 7, in some embodiments, a service rig 216 may not be present, but rather, a standard surface wellhead completion (or sub-surface wellhead completion in some embodiments) may be associated with the system 200. The extraction wellbore 218 may be drilled into the subterranean formation 208 using any suitable drilling technique. The extraction wellbore 218 extends substantially vertically away from the earth's surface 204 over a vertical extraction wellbore portion 220, deviates from vertical relative to the earth's surface 204 over a deviated extraction wellbore portion 222, and transitions to a horizontal extraction wellbore portion 224. A portion of horizontal extraction wellbore portion 224 is located directly below and offset from horizontal injection wellbore portion 214. In some embodiments, the portions 214, 224 may be generally vertically offset from each other by about five meters.

System 200 further comprises an injection work string 226 (e.g., production string/tubing) comprising a plurality of tools 100' each configured in an outflow control configuration. Similarly, system 200 comprises an extraction work string 228 (e.g., production string/tubing) comprising a plurality of tools 100 each configured in an inflow control configuration. It will be appreciated that annular zonal isolation devices 230 may be used to isolate annular spaces of the injection wellbore 206 associated with tools 100' from each other within the injection wellbore 206. Similarly, annular zonal isolation devices 230 may be used to isolate annular spaces of the extraction wellbore 218 associated with tools 100 from each other within the extraction wellbore 218.

While system 200 is described above as comprising two separate wellbores 206, 218, alternative embodiments may be configured differently. For example, in some embodiments work strings 226, 228 may both be located in a single wellbore. Alternatively, vertical portions of the work strings 226, 228 may both be located in a common wellbore but may each extend into different deviated and/or horizontal wellbore portions from the common vertical portion. Alternatively, vertical portions of the work strings 226, 228 may be located in separate vertical wellbore portions but may both be located in a shared horizontal wellbore portion. In each of the above described embodiments, tools 100 and 100' may be used in combination and/or separately to deliver fluids to the wellbore with an outflow control configuration and/or to recover fluids from the wellbore with an inflow control configuration. Still further, in alternative embodiments, any combination of tools 100 and 100' may be located within a shared wellbore and/or amongst a plurality of wellbores and the tools 100 and 100' may be associated with different and/or shared isolated annular spaces of the wellbores, the annular spaces, in some embodiments, being at least partially defined by one or more zonal isolation devices 230.

In operation, steam may be forced into the injection work string 226 and passed from the tools 100' into the formation 208. Introducing steam into the formation 208 may reduce the viscosity of some hydrocarbons affected by the injected steam, thereby allowing gravity to draw the affected hydrocarbons downward and into the extraction wellbore 218. The extraction work string 228 may be caused to maintain an internal bore pressure (e.g., a pressure differential) that tends to draw the affected hydrocarbons into the extraction work string 228 through the tools 100. The hydrocarbons may thereafter be pumped out of the extraction wellbore 218 and into a hydrocarbon storage device and/or into a hydrocarbon delivery system (i.e., a pipeline). It will be appreciated that the bores 114 of tools 100, 100' may form portions of internal bores of extraction work string 228 and injection work string 226, respectively. Further, it will be appreciated that fluid transferring into and/or out of tools 100, 100' may be considered to have been passed into and/or out of extraction wellbore 218 and injection wellbore 206, respectively. Accordingly, the present disclosure contemplates transferring fluids between a wellbore and a work string associated with the wellbore through a fluid diode. In some embodiments, the fluid diodes form a portion of the work string and/or a tool of the work string.

It will be appreciated that in some embodiments, a fluid diode may selectively provide fluid flow control so that resistance to fluid flow increases as a maximum fluid mass flow rate of the fluid diode is approached. The fluid diodes disclosed herein may provide linear and/or non-linear resistance curves relative to fluid mass flow rates therethrough. For example, a fluid flow resistance may increase exponentially in response to a substantially linear increase in fluid mass flow rate through a fluid diode. It will be appreciated that such fluid flow resistance may encourage a more homogeneous mass flow rate distribution amongst various fluid diodes of a single fluid flow control tool 100, 100'. For example, as a fluid mass flow rate through a first fluid diode of a tool increases, resistance to further increases in the fluid mass flow rate through the first fluid diode of the tool may increase, thereby promoting flow through a second fluid diode of the tool that may otherwise have continued to experience a lower fluid mass flow rate therethrough.

It will be appreciated that any one of the inner ports 118, outer ports 120, diode apertures 122, and slits 128 may be laser cut into metal tubes to form the features disclosed herein. Further, a relatively tight fitting relationship between the diode sleeve 106 and each of the inner ported sleeve 104 and outer ported sleeve 108 may be accomplished through close control of tube diameter tolerances, resin and/or epoxy coatings applied to the components, and/or any other suitable methods. In some embodiments, assembly of the diode sleeve 106 to the inner ported sleeve 104 may be accomplished by heating the diode sleeve 106 and cooling the inner ported sleeve 104. Heating the diode sleeve 106 may uniformly enlarge the diode sleeve 106 while cooling the inner ported sleeve 104 may uniformly shrink the inner ported sleeve 104. In these enlarged and shrunken states, an assembly tolerance may be provided that is greater than the assembled tolerance, thereby making insertion of the inner ported sleeve 104 into the diode sleeve 106 easier. A similar process may be used to assemble the diode sleeve 106 within the outer ported sleeve 108, but with the diode sleeve 106 being cooled and the outer ported sleeve being heated.

In alternative embodiments, the diode sleeve 106 may be movable relative to the inner ported sleeve 104 and the outer ported sleeve 108 to allow selective reconfiguration of a fluid flow control tool 100 to an inflow control configuration from an outflow control configuration and/or from an outflow control configuration to an inflow control configuration. For example, tools 100, 100' may be configured for such reconfiguration in response to longitudinal movement of the diode sleeve 106 relative to the inner ported sleeve 104 and the outer ported sleeve 108, rotation of the diode sleeve 106 relative to the inner ported sleeve 104 and the outer ported sleeve 108, or a combination thereof. In further alternative embodiments, a fluid flow control tool may comprise more or fewer fluid diodes, the fluid diodes may be closer to each other or further apart from each other, the various fluid diodes of a single tool may provide a variety of maximum fluid flow rates, and/or a single tool may comprise a combination of diodes configured for inflow control and other fluid diodes configured for outflow control.

It will further be appreciated that the fluid flow paths associated with the fluid diodes may be configured to maintain a maximum cross-sectional area to prevent clogging due to particulate matter. Accordingly, the fluid diodes may provide flow control functionality without unduly increasing a likelihood of flow path clogging. In this disclosure, it will be appreciated that the term "fluid diode" may be distinguished from a simple check valve. Particularly, the fluid diodes 112 of the present disclosure may not absolutely prevent fluid flow in a particular direction, but rather, may be configured to provide variable resistance to fluid flow through the fluid diodes, dependent on a direction of fluid flow. Fluid diodes 112 may be configured to allow fluid flow from a high resistance entry 124 to a low resistance entry 126 while also being configured to allow fluid flow from a low resistance entry 126 to a high resistance entry 124. Of course, the direction of fluid flow through a fluid diode 112 may depend on operating conditions associated with the use of the fluid diode 112.

Figure 8:
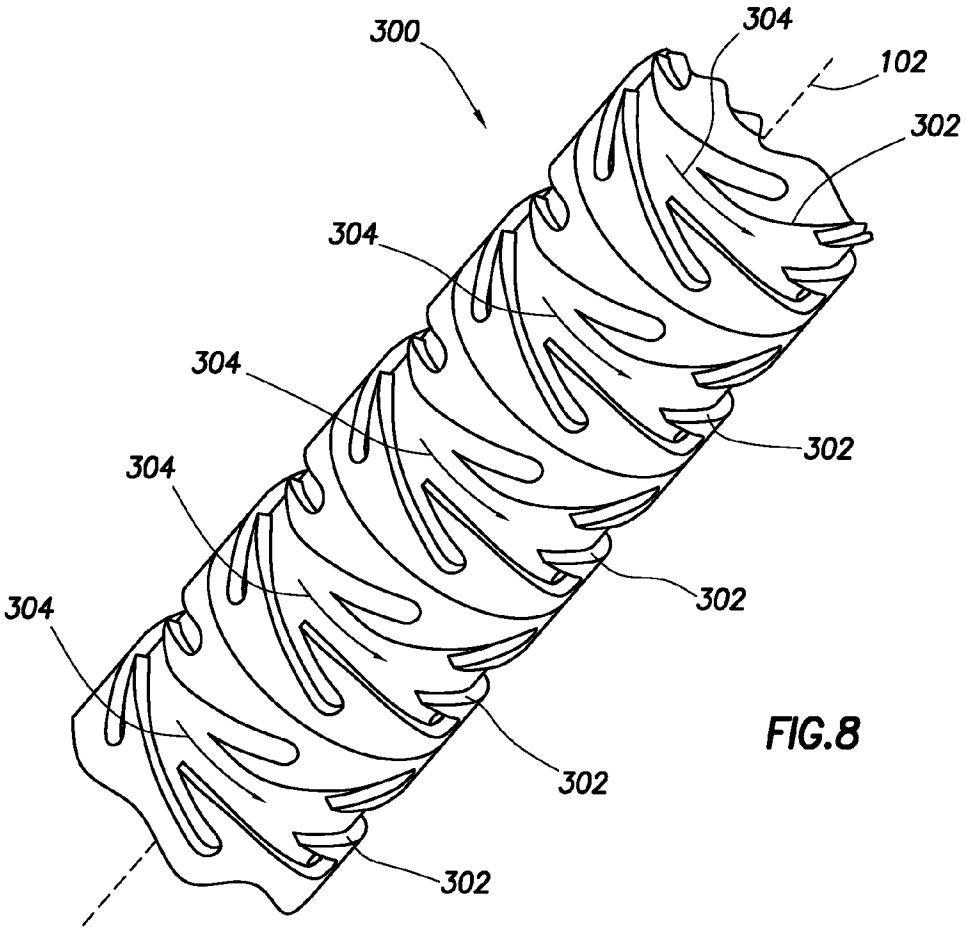
FIG. 8 is an oblique view of a diode sleeve according to another embodiment of the disclosure.

Referring now to FIG. 8, an alternative embodiment of a diode sleeve 300 is shown. Diode sleeve 300 comprises diode apertures 302, each comprising a high resistance entry and a low resistance entry. It will be appreciated that the systems and methods disclosed above with regard to the use of inner ported sleeves 104, outer ported sleeves 108, and outer perforated liners 110 may be used to selectively configure a tool comprising the diode sleeve 300 to provide selected directional resistance of fluid transfer between bores 114 and fluid gap spaces 116. In this embodiment, diode apertures 302 substantially wrap concentrically about the central axis 102. In this embodiment, a fluid flow generally in the direction of the arrows 304 encounters higher resistance than a substantially similar fluid flow in an opposite direction would encounter. Of course, further alternative embodiments of diode sleeves and diode apertures may comprise different shapes and/or orientations.

Figure 9:
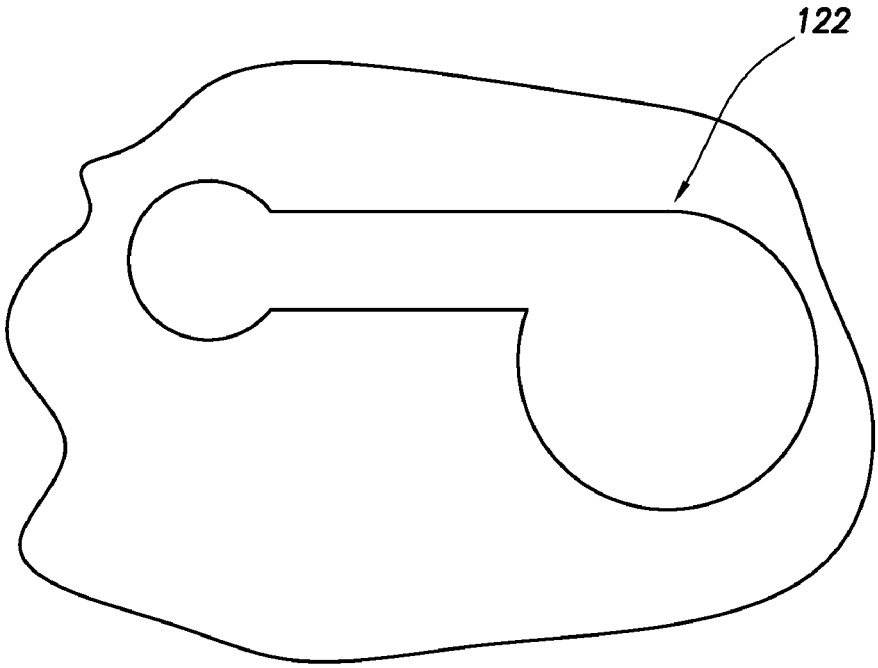
FIG. 9 is an orthogonal view of a diode aperture of the fluid flow control tool of FIG. 1 as laid out on a planar surface.

Referring now to FIG. 9, an orthogonal view of the shape of the diode aperture 122 as laid out flat on a planar surface is shown.

Figure 10:
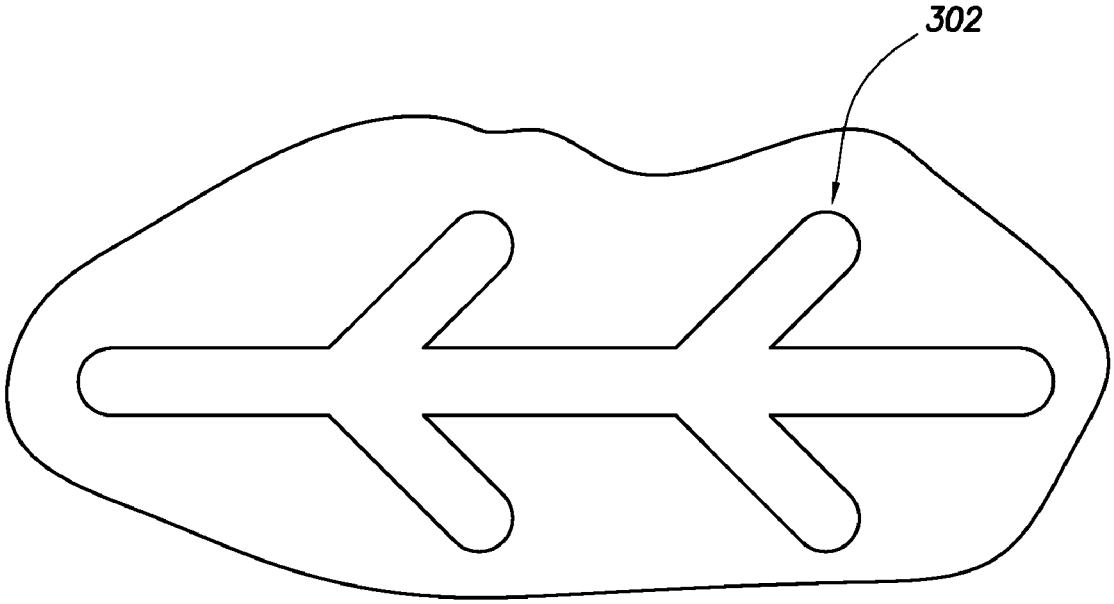
FIG. 10 is an orthogonal view of a diode aperture of the diode sleeve of FIG. 8 as laid out on a planar surface.

Referring now to FIG. 10, an orthogonal view of the shape of the diode aperture 302 as laid out flat on a planar surface is shown.

Figure 11:
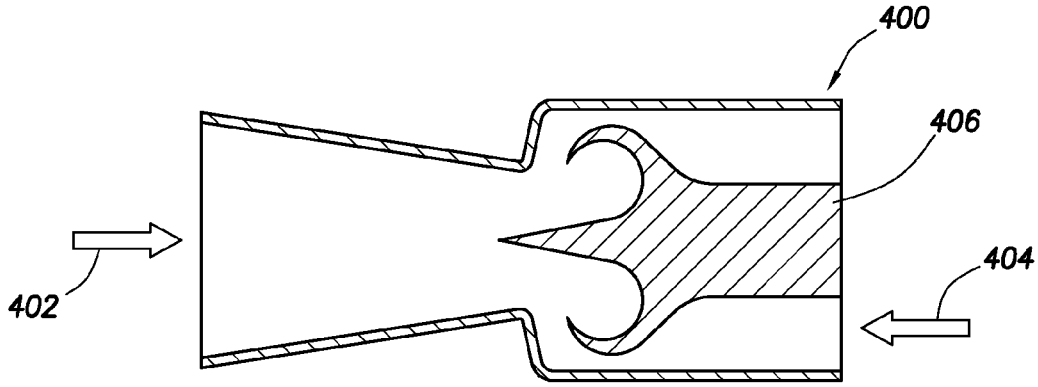
FIG. 11 is an orthogonal view of a diode aperture according to another embodiment of the disclosure.

Referring now to FIG. 11, an orthogonal view of a diode aperture 400 is shown. Diode aperture 400 is generally configured so that fluid movement in a reverse direction 402 experiences higher flow resistance than fluid movement in a forward direction 404. It will be appreciated that the geometry of the internal flow obstruction 406 contributes to the above-described directional differences in fluid flow resistance.

Figure 12:
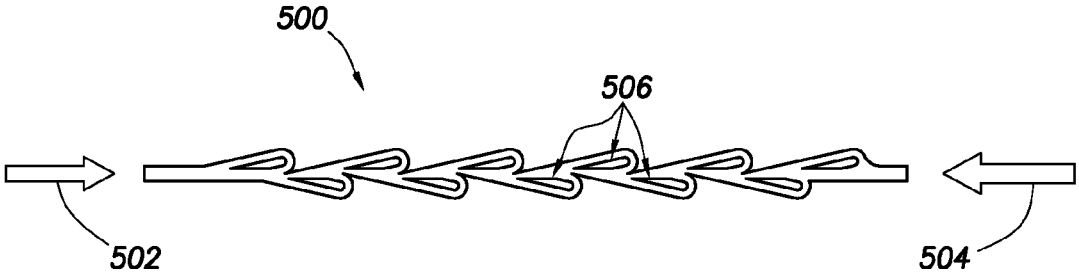
FIG. 12 is an orthogonal view of a diode aperture according to still another embodiment of the disclosure.

Referring now to FIG. 12, an orthogonal view of a diode aperture 500 is shown. Diode aperture 500 is generally configured so that fluid movement in a reverse direction 502 experiences higher flow resistance than fluid movement in a forward direction 504. Diode aperture 500 is configured for use with island-like obstructions 506 that interfere with fluid flow through diode aperture 500. Obstructions 506 may be attached to or formed integrally with one or more of an inner ported sleeve 104, a diode sleeve 106, and/or an outer ported sleeve 108. In some embodiments, obstructions 506 may be welded or otherwise joined to the inner ported sleeve 104.

Figure 13:
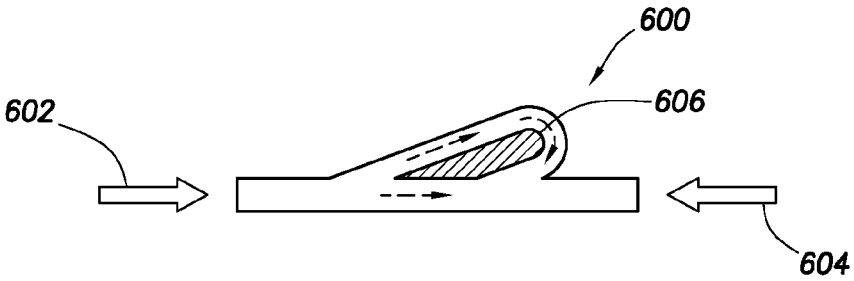
FIG. 13 is an orthogonal view of a diode aperture according to yet another embodiment of the disclosure.

Referring now to FIG. 13, an orthogonal view of a diode aperture 600 is shown. Diode aperture 600 is generally configured so that fluid movement in a reverse direction 602 experiences higher flow resistance than fluid movement in a forward direction 604. Diode aperture 600 is configured for use with island-like obstructions 606 that interfere with fluid flow through diode aperture 600. Obstructions 606 may be attached to or formed integrally with one or more of an inner ported sleeve 104, a diode sleeve 106, and/or an outer ported sleeve 108. In some embodiments, obstructions 606 may be welded or otherwise joined to the inner ported sleeve 104.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What we claim as our invention is:

1. A method of servicing a wellbore, comprising:

providing a fluid diode in fluid communication with the wellbore, wherein the fluid diode is disposed within the wellbore; and transferring a fluid through the fluid diode.

2. The method of claim 1, wherein the transferring comprises removing the fluid from the wellbore.

3. The method of claim 2, wherein the fluid comprises hydrocarbons produced from a hydrocarbon formation with which the wellbore is associated.

4. The method of claim 3, wherein the transferring comprises providing the fluid to the wellbore.

5. The method of claim 4, wherein the fluid comprises steam.

6. The method of claim 1, wherein the fluid diode provides a non-linearly increasing resistance to the transferring in response to a linear increase in a fluid mass flow rate of the fluid through the fluid diode.

7. The method of claim 1, wherein the fluid diode is further in fluid communication with an internal bore of a work string.

8. A method of servicing a wellbore, comprising:

providing a fluid diode in fluid communication with the wellbore; and transferring a fluid through the fluid diode wherein the fluid diode is provided by a fluid flow control tool, comprising:

a tubular diode sleeve comprising a diode aperture;

a tubular inner ported sleeve received concentrically within the diode sleeve, the inner ported sleeve comprising an inner port in fluid communication with the diode aperture; and a tubular outer ported sleeved within which the diode sleeve is received concentrically, the outer ported sleeve comprising an outer port in fluid communication with the diode aperture;

wherein a shape of the diode aperture, a location of the inner port relative to the diode aperture, and a location of the outer port relative to the diode aperture provide a fluid flow resistance to fluid transferred to the inner port from the outer port and a different fluid flow resistance to fluid transferred to the outer port from the inner port.

9. The method of claim 8, wherein the diode aperture is configured to provide a vortex diode.

10. The method of claim 8, wherein the fluid flow control tool further comprises a perforated liner within which the outer ported sleeve is concentrically received so that a fluid gap space is maintained between the perforated liner and the outer ported sleeve.

11. The method of claim 10, wherein a fluid flow resistance varies non-linearly in response to a linear variation in a fluid mass flow rate of fluid transferred between the inner port and the outer port.

12. A method of recovering hydrocarbons from a subterranean formation, comprising:

injecting steam into a wellbore that penetrates the subterranean formation, the steam promoting a flow of hydrocarbons of the subterranean formation; and receiving at least a portion of the flow of hydrocarbons;

wherein at least one of the injecting steam and the receiving the flow of hydrocarbons is controlled by a fluid diode.

13. The method of claim 12, wherein the receiving the flow of hydrocarbons is at least partially gravity assisted.

14. The method of claim 12, wherein the steam is injected at a location higher within the formation than a location at which the flow of hydrocarbons is received.

15. The method of claim 12, wherein the steam is injected into a first wellbore portion while the flow of hydrocarbons is received from a second wellbore portion.

16. The method of claim 15, wherein the first wellbore portion and the second wellbore portion are vertically offset from each other.

17. The method of claim 15, wherein the first wellbore portion and the second wellbore portion are both horizontal wellbore portions that are both associated with a shared vertical wellbore portion.

18. The method of claim 12, wherein the steam is injected through a fluid diode having an outflow control configuration while the flow of hydrocarbons is received through a fluid diode having an inflow control configuration.

19. The method of claim 18, wherein at least one of the fluid diodes is associated with an isolated annular space of the wellbore that is at least partially defined by a zonal isolation device.

20. A method of servicing a wellbore, comprising:

providing a fluid diode in fluid communication with the wellbore; and removing a first fluid from the wellbore via the fluid diode, wherein the first fluid comprises hydrocarbons produced from a hydrocarbon formation with which the wellbore is associated; and providing a second fluid to the wellbore via the fluid diode.

21. The method of claim 20, wherein the second fluid comprises steam.

* * * * *